United States Patent [19]

Arrasmith et al.

[11] 4,189,133

[45] Feb. 19, 1980

[54] DOCUMENT STACKING TABLE LOWERING METHOD, APPARATUS AND CONTROLLING CIRCUITRY THEREFOR

[75] Inventors: Fred V. Arrasmith, San Jose; Donald G. Bruns, Saratoga; David G. Killam, San Jose, all of Calif.

[73] Assignee: International Business Machines Corporation, Armonk, N.Y.

[21] Appl. No.: 957,510

[22] Filed: Nov. 3, 1978

[51] Int. Cl.[2] ..... B65H 45/101; B65H 31/10

[52] U.S. Cl. ..... 270/61 F; 226/1; 226/200; 235/92 PE; 271/215; 414/100; 414/901

[58] Field of Search ..... 271/215, 217, 218, 219, 271/214; 414/100, 901; 270/61 F; 226/1, 10, 200, 118, 119; 235/92 CC, 92 PE

[56] References Cited

U.S. PATENT DOCUMENTS

| | | | |
|---|---|---|---|
| 2,861,805 | 11/1958 | Auer | 271/215 |
| 3,640,407 | 2/1972 | Anastasio et al. | 414/100 X |
| 3,807,724 | 4/1974 | Bartz | 270/61 F |
| 3,937,456 | 2/1976 | Gruodis | 271/217 X |
| 3,956,616 | 5/1976 | Knollenberg | 235/92 CC |
| 4,033,579 | 7/1977 | Stange et al. | 271/217 X |
| 4,065,123 | 12/1977 | Arrasmith et al. | 271/215 |

*Primary Examiner*—Bruce H. Stoner, Jr.
*Attorney, Agent, or Firm*—George E. Roush

[57] ABSTRACT

A document stacking table is lowered in steps under electronic control as the documents accumulate. A predetermined number of documents are stacked, after which the table is lowered by a predetermined amount. An optical sensing arrangement is used to determine the effective top of the stack of documents within the limits of "light sensed" and the "absence of light". If light is sensed, the count is increased and the table lowered again; in the absence of light the count is decreased and the table is again lowered. Thus the stacking table will be lowered by a fixed amount to the level of least error.

7 Claims, 3 Drawing Figures

Figure 1A:
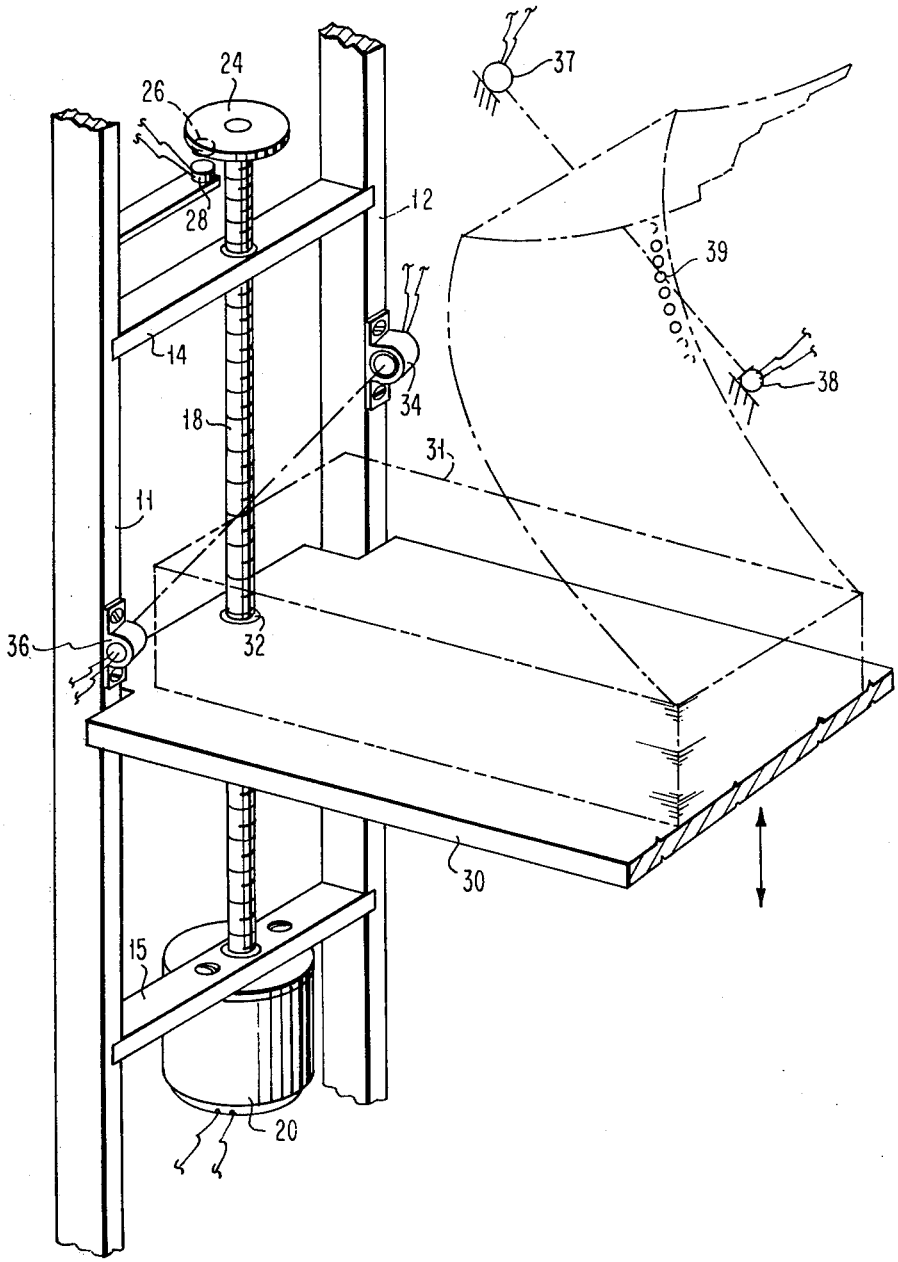

DOCUMENT STACKING TABLE LOWERING METHOD, APPARATUS AND CONTROLLING CIRCUITRY THEREFOR

DESCRIPTION

Technical Field

The invention relates to apparatus for stacking continuous form documents on a table, particularly as they emerge from a document processing machine, and it particularly pertains to apparatus for lowering the table in accordance with the rate of flow of the documents whereby each batch of documents is accepted in substantially the same space as were all of the previous documents.

BACKGROUND

There are a great number of document stacking machines in the prior art, and most of them have been in satisfactory service for many years. As is usually the case, new applications in which the stacking of documents is involved bring out the inadequacies of prior art machinery that were unknown before or were not of major consequence at the time. Stacking apparatus for thermoelectrophotographic printing machinery is subject to a great many requirements heretofor ignored and therefore, among other things, demands relatively precise control and positioning of the effective top of the stack of the documents as they are stacked. An appreciation of the factors involved will be had on inspection of U.S. Pat. No. 3,807,724 to William R. Bartz. The apparatus according to the invention is, therefore, arranged according to a novel method document stack-top height control.

The objects of the invention indirectly referred to hereinbefore and those that will appear as the specification progresses, obtain in a novel combination of mechanical and electric circuit components, constructed individually in accordance with well known principles, and assembled in novel manner in accordance with the invention.

PRIOR ART

Representative prior art is found in the following U.S. patents:

| | | | |
|---|---|---|---|
| 2,861,805 | 11/1958 | Auer | 271/215 |
| 3,640,407 | 2/1972 | Anastasio et al | 414/100 |
| 3,937,456 | 2/1976 | Gruodis et al | 271/64 |
| 4,033,579 | 7/1977 | Stange et al | 271/195 |
| 4,065,123 | 12/1977 | Arrasmith et al | 271/215 |

The patent to Auer shows the control for stacker table height in which the stacking table lowering motor is operated for a time interval after a predetermined number of sheets have been stacked. The time interval is controlled here by a manually adjustable time delay relay. In operation, the time delay relay is adjusted to accommodate the thickness of the particular sheet being printed.

The patents to Anastasio et al and Gruodis et al show a stacker for books or other flat articles in which a photocell and lamp arrangement is utilized to control the table height of the stacker.

Stange et al in their patent describe a stacker in which spring members bias the document toward the stacker platform. The tension in the spring is detected for positioning the platform so that the topmost sheet is located at a predetermined level.

The patent to Arrasmith et al shows apparatus for stacking sheets on edge between a fixed guide and a movable backstop and in which the position of the stacker backstop is controlled in response to the count of a predetermined number of sheets entering the stacker.

While this prior art shows features of interest, it does not disclose the concept of lowering a stacker table by predetermined amounts, counting the sheets added prior to each lowering of the table, and adjusting the sheet count from lowering to lowering for maintaining a substantially constant stack height.

SUMMARY OF THE INVENTION

The objects of the invention indirectly referred to hereinbefore, and those that will appear as the specification progresses, are attained with simple electromechanical document stacking apparatus operated in novel manner under precise control of novel electronic circuitry therefor.

Broadly the invention comprises a method for controlling document-stacking, table-lowering apparatus and controlling circuitry therefor comprising a document stacking table, a sensor for determining the effective height of documents stacked on the table, and electronic machine running circuitry for controlling the operation in accordance with the operational method steps of sensing the state of the effective top of the documents stacked, lowering the table a predetermined distance, feeding a predetermined number of documents onto the table, sensing the state of the effective top of the document stack, incrementing by one the predetermined number in response to a first state of the sensor and repeating the lowering, feeding and sensing steps in response to a second state of the sensor, and decrementing by one the predetermined count in response to N successive occurrences of the second state of the sensor at the sensing step.

Stacking apparatus and electronic controlling circuitry according to the invention is readily assembled from conventional components arranged in a new combination for performing the steps of the novel method hereinbefore described.

DRAWING

Figure 1B:
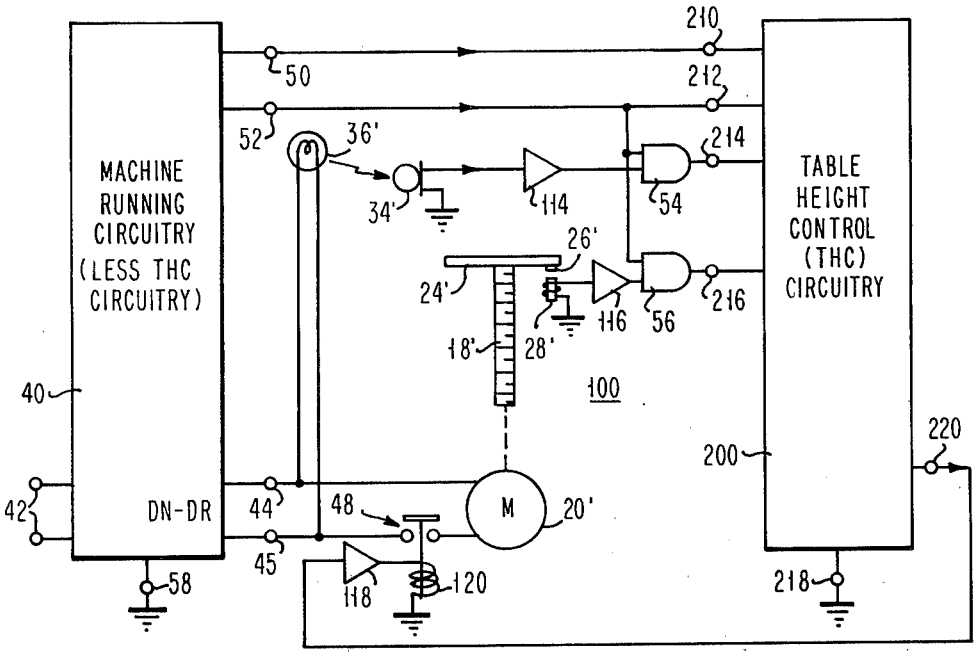
Figure 2:
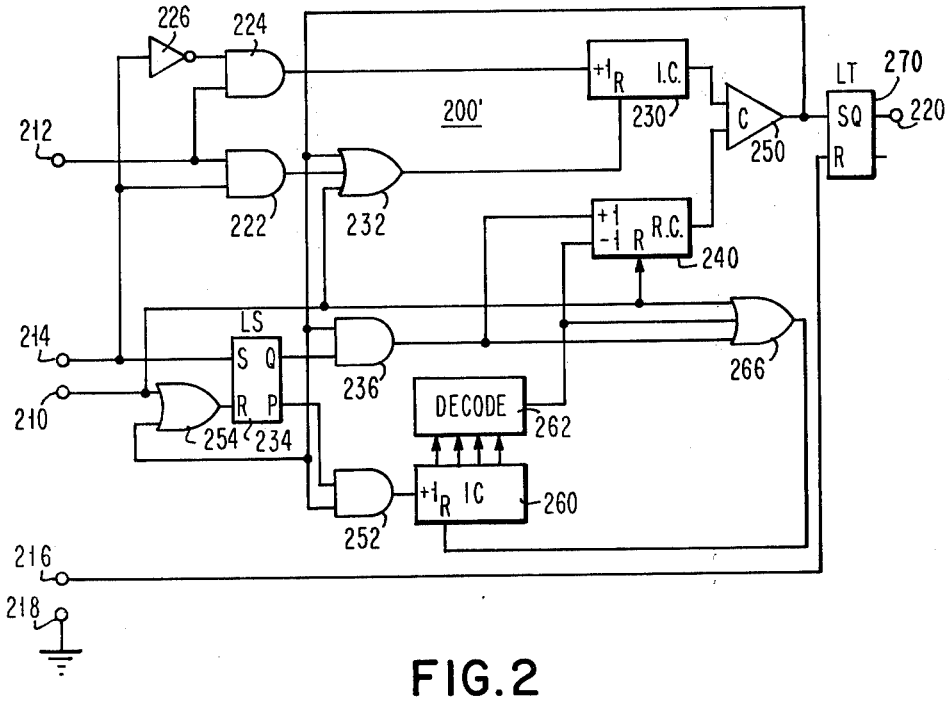

In order that full advantage of the invention obtain in practice, the best mode embodiment thereof, given by way of example, is described in detail hereinafter with reference to the accompanying drawing, forming a part of this specification, and in which:

FIG. 1*a* is an illustration of the mechanical components of apparatus according to the invention;

FIG. 1*b* is a schematic diagram of the essential mechanical components together with the associated electric components as combined therewith according to the invention; and FIG. 2 is a logical circuit diagram of the electronic circuitry according to the invention for controlling the operation of the document stacking apparatus.

DESCRIPTION

Referring to FIG. 1*a*, there is shown components essential to a ready understanding of the apparatus and controlling circuitry according to the invention. A frame for the apparatus comprises a pair of studs 11 and 12 between which a pair of cross members 14 and 15 are mounted. A conventional lead screw 18 is journalled in the cross members 14 and 15 as shown for rotation only about the longitudinal axis. The lead screw 18 is rotated by means of an electric motor 20, shown here for simplicity as directly connected to the screw 18 and fastened to the lower cross member 15 for mechanical support. In actual practice, a pulley and belt drive is preferable for many reasons, none of which bear directly on the invention. At the other end of the lead screw 18 is a disk member 24, which is contemplated for many applications to be one of the drive pulley members hereinbefore mentioned. A permanent magnet 26 is arranged in the disk member 24 and an electromagnetic sensing device 28 is arranged in proximity to the magnet 26 whereby a pulse is generated in the electromagnetic sensing device each time the magnet 26 passes by due to the rotation of the lead screw 18 and the disk 24. A document stacking table 30, fitted at one end with a lead-screw following member 32, is borne by the lead screw 18. Preferably, the other end (not shown) of the table 30 is arranged in similar fashion in an arrangement of studs and cross members except that the table 30 is fitted with a journal having a sliding fit about a cylindrical support member attached to the cross members corresponding to the cross member 14 and 15, rather than another lead screw. However, a heavy stacking table might justify the use of a dual lead-screw support.

Thus, as the motor 20 rotates the lead screw 18, the table 30 will move up or down depending on the direction of rotation. The train of pulses emitting from the electromagnetic sensing device 28 will indicate that the table is moving in one of the two directions, but it will not indicate which direction inasmuch as it will be seen later that the direction is readily determined elsewhere in the arrangement according to the invention. The table 30 will be moved a fixed distance for each revolution of the screw 18. Depending on the thickness of the documents to be stacked, 10–20 documents will be stacked between pulses from the magnetic sensor 26–28 in a practical application.

Documents are stacked on the table 30. The effective top (a term which will be defined hereinafter) of the stack 31 of documents, indicated here only in phantom, is sensed by a conventional photoelectric sensing arrangement, shown here as comprising a lamp 34 arranged on one stud 12 and a photosensing device 36 arranged on the other stud 11. Better control is afforded by having the arrangement of the lamp 34 and the photosensing device 36 aligned to sense the presence or absence of a document at a top corner of the stack, rather than being arranged parallel to the nominal top surface of the stack of documents as in the prior art. A similar photoelectric sensing arrangement is suggested as one arrangement for counting sheets as they arrive in readiness for stacking shown here only schematically as a lamp 37 and photocell 38 arranged to produce a pulse at each line of perforation 39 as encountered.

Of course the document handling apparatus is arranged for moving the table 30 up and down at differing speeds for locating the initial position of the table and/or stacking documents. Because the invention is directed to the stacking of documents only, the remainder of the description will consider the apparatus as though arranged only for lowering the table in the document stacking operation.

The principle components of the circuitry for controlling the movement in lowering the table are shown in FIG. 1*b*. Only the essential factors are shown here; those skilled in the art will readily apply the principles set forth to the application at hand. The arrangement is divided into three parts for clarity in explanation. The first part comprises machine running circuitry 40 as will be more completely described hereinafter. The second part 100 comprises those components illustrated in the previous figure which are necessary for the understanding of control according to the invention, but which are more or less conventional in form as to the individual components. The heart of the invention is contained in the table height control circuitry 200, which in and of itself is a part of the machine running circuitry 40, and is so indicated in the legend for that part.

Electric power for the machine running circuit 40 is applied at input terminals 42. One of the portions of the machine running circuitry 40 is devoted to providing electric power of the required voltages and currents and at the proper time for the motor 20'. As shown here, the machine running circuitry 40 delivers electric "down driving" power at terminals 44, 45 during the time in which the motor 20' may be driven downward, but the motor also may be held idle as by the open contacts 48, later to be more completely described. A lamp 36' is also conveniently powered from the motor drive power terminals 44, 45 for controlling the downward movement of the table. The machine running circuitry 40 also is arranged to supply an initiating pulse at terminals 50, which pulse serves to reset various components of the overall circuitry as will be described more completely hereinafter. Also, a pulse for each sheet to be stacked on the table (or from the photocell 38) is delivered to an appropriate terminal 52 for application among other things to AND gating circuits 54 and 56, also to be described more completely hereinafter. These pulses preferably are referenced to machine ground, for which purpose the ground terminal 58 is provided. The exciter lamp 36' is arranged to excite the photocell 34' when no document prevents the light from the lamp 36' from striking the photocell 34'. The output of the photocell 34' is applied through an amplifying circuit 114, the output of which is applied to the AND gating circuit 54 leading to the table height control circuitry 200. An electromagnetic detector 28' is likewise connected to an amplifying circuit 116 having the output thereof applied to the AND gating circuit 56 also leading to the table height control circuitry. A power driver amplifying circuit 118 is arranged to power the solenoid 120 for closing the contact assembly 48 as will later be more fully described. The table height control circuitry 200 has a reset pulse input terminal 210 which is connected to the initializer pulse output terminal 50 of the machine running circuit 40. The sheet pulse output terminal 52 is likewise connected to the input terminal 212 for counting the documents as they are stacked up on the table. An indication of table height is received at the input terminal 214 along with an indication of whether the table has moved, which is received at input terminal 216. Preferably as before, the terminals 210 . . . 216 are arranged for signals referenced to machine ground as evidenced by the ground terminal 218. The table height control circuitry 200 delivers a pulse referenced to ground, at an output terminal 220 which is connected to the driver amplifying circuit 118 for closing the contacts 48 and thereby lowering the table as desired.

A logical diagram of the table height control circuitry 200' is shown in FIG. 2. The sheet count pulse input terminal 212 is connected to one lead each of AND gating circuits 222 and 224. The stack height indicating pulse terminal 214 is connected to another input lead at the AND gating circuit 222 and through an inverting circuit 226 to the other lead of the AND gating circuit 224. The output lead of the AND gating circuit 224 is connected to the incrementing input terminal of an incrementing counting circuit 230. The latter circuit is reset upon the application of a pulse from an output lead of the AND gating circuit 222 which is applied through an OR gating circuit 232. The stack height indicating pulse terminal 214 is also connected to the set input terminal of a set-reset flip-flop circuit 234. The erect (Q) output terminal of the flip-flop circuit 234 is connected to an input lead of an AND gating circuit 236, the output lead of which is connected to the incrementing input terminal of a reversible counting circuit 240. The counting circuit 240 is initially loaded with a number which is close to but less than the desired number of documents. The counting output terminals of the counting circuits 230 and 240 are connected to a comparing circuit 250. The output lead of the latter is connected to another input lead of the OR gating circuit 232, another input lead of the AND gating circuit 236 and input lead of another AND gating circuit 252 and to the input lead of another OR gating circuit 254 the output lead of which is connected to the reset terminal of the flip-flop circuit 234. The complementary P ($=\overline{Q}$) output terminal of the flip-flop circuit 234 is connected to the other input lead of the AND gating circuit 252. Alternatively, if desired, the erect or Q output terminal of the flip-flop circuit 234 is connected by means of an inverting circuit (not shown) to this other input lead of the AND gating circuit 252. The output lead of the latter AND circuit is connected to the incrementing input terminal of an incrementing counter circuit 260. The count output terminals of the counter circuit 260 are connected to a decoding circuit 262 from which the decoded number is applied to the decrementing input terminal of the reversible counting circuit 240. Alternatively, the decrementing input terminal of the counting circuit 240 may be connected to the desired counting output terminal of the counter circuit 260, however, the decoding circuit 262 is preferred because the number to be decoded is more readily changed from application to application as is often desirable. The counter circuit 260 is reset through an OR gating circuit 266 having one input lead connected to the decoding circuit 262. Another input lead of the OR gating circuit 266 is connected to the initiating pulse terminals 210, which are also connected to a third input lead of the OR gating circuit 232 and the reset input terminal of the counting circuit 240. The output terminal of the comparing circuit 250 is applied to the set terminal of a set-reset flip-flop or latching, circuit 270. The table movement indicating pulse applied at the terminal 216 is connected to the reset terminal of the flip-flop circuit 270 and the output Q terminal is connected to the output terminal 220 of the control circuitry 200'.

According to the invention, the circuitry is arranged to control the top of a document-stack by lowering the stacking table by uniform amounts and regulating the point at which the lowering is initiated to control the resultant effective stack-top height. An additional feature is the continuous generation of the document count as the stacking progresses. With a constant amount of downward travel each time the document stacking table is lowered to the level where the height photosensor is uncovered, the number of documents counted before lowering again is increased by one. When the number is large enough, the photosensor will just remain covered after a lowering. After several such lowerings without the photosensor being uncovered, there is statistical justification to decrease the number by one. In practice, 20 such passes have been accumulated before decrementing. Thus, the stacking table will always be lowered a fixed amount to the level of least error, giving a precise stacking control over a widely variable range.

The counter 230 is used to count the number of documents stacked before lowering after the effective top-of-the-stack photosensor is covered. It is reset to zero initially and each time a document pulse (one pulse for each arriving sheet) arrives if and when the photosensor is detecting light. Each sheet pulse arriving when the photosensor is not detecting light causes the counter 230 to be incremented by one. The other counting circuit 240 contains the number of sheets to be counted after the sensor is dark and before the table is lowered; it is initially loaded a number close to but less than the desired number. In practice the number is often 10. The counter circuit 260 accumulates the number of consecutive table lowerings before the photosensor detects light. When the contents of the counter 260 are decoded to be the desired number of lowering without light, the counter 240 is decremented by one, and the counter circuit 260 is reset to zero. The light sensing latch 234 is set by the detection of light on the top-of-the-stack photosensor at any time and pegs this condition. This flip-flop circuit 234 is reset initially and at each time the table is lowered. The latch 270 is set to start the drive motor which has been connected to lower the stacking table through the mechanical drive which includes the screw 18. When the drive has moved a measured amount, here the distance that the table is lowered by one full revolution of the screw 18, for example, usually 10–20 documents depending on thickness, the table movement sensor pulse resets the flip-flop circuit 270 to stop the motor.

While the invention has been described in terms of an express embodiment, and alternatives have been suggested, it is clearly to be understood that those skilled in the art will effect further changes without departing from the spirit and scope of the invention as defined in the appended claims concluding the specification.

The invention claimed is:

1. Document stacking table lowering method operating in accordance with the following steps, initiating operation on sensing one condition of the height of the documents being stacked, feeding a predetermined number of documents onto said stacking table, lowering said stacking table a predetermined distance, adjusting said number selectively by decreasing said predetermined number on determination that said stack height is in said one condition and increasing said predetermined number on determination that said stack height is in another condition, feeding a number of documents as adjusted onto said stacking table, lowering said stacking table by said predetermined distance, and repeating the feeding, lowering and adjusting steps.

2. Document stacking table lowering method as defined in claim 1, and wherein said adjusting step decreases said predetermined number in response to a prearranged number of successive determinations of said other condition.

3. Document stacking table lowering method as defined in claim 2, and wherein said prearranged number is of the order of twice said predetermined number.

4. Document stacking table lowering apparatus and controlling circuitry therefor comprising a frame, a mechanism arranged in said frame for feeding documents one after the other, a table on which said documents are to be stacked and which is to be lowered as the documents are deposited thereon in order that all of the documents are accepted in substantially the same space, an elevator mechanism arranged in said frame and coupled to said table for raising and lowering said table, a sensing device arranged in conjunction with said elevator mechanism for determining that said mechanism has moved said table a predetermined distance, a sensor mounted on said frame for determining the effective height of a stack of documents on said table, a source of pulses synchronized with said feeding mechanism whereby said pulses are indicative of said documents as they appear in readiness for stacking, an incrementing counting circuit having an input terminal coupled to said source of pulses, a reset terminal coupled to said sensor and count output terminals at which is delivered the number of documents stacked before lowering the stacking table and after said sensor is indicating the presence of documents in the stack, a reversible counting circuit having an incrementing input terminal coupled to said sensor, a decrementing input terminal and count output terminals at which is delivered the number of documents in response to said sensor indicating the presence of documents and before said table is again lowered, a comparing circuit having input terminals individually connected to said count output terminals of said incrementing and said reversible counting circuits, and having an output terminal coupled to said reset terminal of said incrementing counting circuit for resetting the latter upon determining the equality of said numbers, an incrementing counter circuit arrangement having an incrementing input terminal, and an output terminal connected to said decrementing input terminal of said reversible counting circuit for decrementing the latter upon the decoding of a prearranged number of table lowerings, a latching circuit having a set terminal connected to said sensor, a reset terminal coupled to said output terminal of said comparing circuit and complementary output terminals, with one of said output terminals coupled to said reset terminal of said incrementing counter circuit and the complementary output terminal connected to said incrementing input terminal of said incrementing counter circuit for counting the number of consecutive lowerings of said table with said sensor indicating the presence of documents in the stack, and another latching circuit having a set terminal connected to said output terminal of said comparing circuit, a reset terminal connected to said table movement sensing device, and having an output terminal coupled to said elevator mechanism for enabling the lowering thereof.

5. Document stacking table lowering apparatus and controlling circuitry therefor comprising a frame, a mechanism arranged in said frame for feeding documents one after the other, a table on which said documents are to be stacked and which is to be lowered as the documents are deposited thereon in order that all of the documents are accepted in substantially the same space, an elevator mechanism arranged in said frame and coupled to said table for raising and lowering said table, a sensing device arranged in conjunction with said elevator mechanism for determining that said mechanism has moved said table a predetermined distance, a sensor mounted on said frame for determining the effective height of a stack of documents on said table, a source of pulses synchronized with said feeding mechanism whereby said pulses are indicative of said documents as they appear in readiness for stacking, an incrementing counting circuit having an input terminal coupled to said source of pulses, a reset terminal and count output terminals, a reversible counting circuit having an incrementing input terminal coupled to said sensor, a decrementing input terminal, a reset terminal and count output terminals, a comparing circuit having input terminals individually connected to said count output terminals of said incrementing and said reversible counting circuits, and having an output terminal coupled to said reset terminal of said incrementing counting circuit, an incrementing counter circuit having an incrementing input terminal, a reset terminal and count output terminals, a decoding circuit having input terminals connected to said count output terminals of said incrementing counter circuit and an output terminal connected to said decrementing input terminal of said reversible counting circuit, a latching circuit having a set terminal connected to said sensor, a reset terminal coupled to said output terminal of said comparing circuit and complementary output terminals, with one of said output terminals coupled to said reset terminals of said incrementing counter circuit and the complementary output terminal connected to said incrementing input terminal of said incrementing counter circuit, a source of reset pulse and electric connections from that source to the first said reset terminals of said incrementing and said reversible counting circuits, and said latching circuit, and another latching circuit having a set terminal connected to said output terminal of said comparing circuit, a reset terminal connected to said table movement sensing device, and having an output terminal coupled to said elevator mechanism.

6. Document stacking table lowering apparatus and controlling circuitry therefor comprising, a first input terminal at which is applied a train of pulses indicative of documents as they arrive in readiness for stacking on said table, a second input terminal at which electric levels are applied which indicate the presence and absence of the effective top of a stack of documents on said table, a third input terminal at which pulses are applied which indicate a measure of movement of said document stacking table, an incrementing counting circuit having an input terminal, a reset terminal and a count output terminal, a reversible counting circuit having an incrementing input terminal, a decrementing input terminal, a reset terminal and count output terminals, one AND gating circuit having an input lead connected to said first input terminal, another input lead and an output lead connected to said input terminal of said incrementing counting circuit, another AND gating circuit having an input lead connected to said first input terminal, another input lead connected to said second input terminal, and an output lead, an inverting circuit connected between said second input terminal and said other input lead of said one AND gating circuit, one OR gating circuit having one input lead connected to said output lead of said other AND gating circuit, another input lead, a further input lead and an output lead connected to said reset terminal of said incrementing counting circuit, a latching circuit having a set terminal connected to said second input terminal, a reset terminal and complementary output terminals, a further AND gating circuit having one input lead connected to one output terminal of said latching circuit, another input lead, and an output lead connected to the incrementing input terminal of said reversible counting circuit, a comparing circuit having input terminals individually connected to said count output terminals of said incrementing and said reversible counting circuits, and having an output terminal connected to one other input lead of said OR gating circuit and to said other input lead of said further AND gating circuit, an incrementing counter circuit arrangement having an incrementing input terminal, a reset terminal and having an output terminal connected to said decrementing input terminal of said reversible counting circuit, an additional AND gating circuit having an input lead connected to the other of said complementary output terminals of said latching circuit, an input lead connected to the output terminal of said comparing circuit and an output lead connected to said incrementing input terminal of said incrementing counter circuit, another OR gating circuit having an input lead connected to said output terminal of said incrementing counter circuit, an input lead connected to the output lead of said further AND gating circuit, an input lead connected to said second input terminal and an output lead connected to said reset terminal of said incrementing counter circuit, a fourth input terminal at which a reset pulse is applied and electric connections from that terminal to said reset terminals of the first of said incrementing and of said reversible counting circuits, and of said latching circuit, and another latching circuit having a set terminal connected to said output terminal of said comparing circuit, a reset terminal connected to said third input terminal and having an output terminal at which an electric level is delivered indicating the lowering of said table is in order.

7. Document stacking table lowering apparatus and controlling circuitry therefor as in claim 6, and wherein said incrementing counter circuit arrangement comprises an incrementing counter circuit having an incrementing input terminal, a reset terminal and count output terminals, and a decoding circuit having input terminals connected to said count output terminals of said incrementing counter circuit and having an output terminal connected to said decrementing input terminal of said reversible counting circuit.

* * * * *